US009067452B2

(12) United States Patent
Iguchi

(10) Patent No.: US 9,067,452 B2
(45) Date of Patent: Jun. 30, 2015

(54) ERASING APPARATUS

(71) Applicants: Kabushiki Kaisha Toshiba, Tokyo (JP); Toshiba Tec Kabushiki Kaisha, Tokyo (JP)

(72) Inventor: Ken Iguchi, Shizuoka-ken (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/168,251

(22) Filed: Jan. 30, 2014

(65) Prior Publication Data

US 2014/0213443 A1 Jul. 31, 2014

(30) Foreign Application Priority Data

Jan. 31, 2013 (JP) ..... 2013-017423

(51) Int. Cl.

*B41J 29/16* (2006.01)
*B41M 5/30* (2006.01)
*F27D 19/00* (2006.01)

(52) U.S. Cl.

CPC ..... *B41M 5/305* (2013.01); *F27D 19/00* (2013.01)

(58) Field of Classification Search

USPC ..... 347/171, 179
See application file for complete search history.

(56) References Cited

U.S. PATENT DOCUMENTS

| | | | | |
|---|---|---|---|---|
| 2011/0221851 | A1* | 9/2011 | Kawaguchi et al. | 347/179 |
| 2012/0306985 | A1* | 12/2012 | Iguchi et al. | 347/179 |
| 2013/0002784 | A1 | 1/2013 | Iguchi et al. | |
| 2013/0250025 | A1* | 9/2013 | Kaneko et al. | 347/179 |
| 2013/0258026 | A1* | 10/2013 | Iguchi | 347/179 |
| 2014/0204168 | A1* | 7/2014 | Umetsu | 347/179 |

FOREIGN PATENT DOCUMENTS

| | | |
|---|---|---|
| JP | 2005003818 | 1/2005 |
| JP | 2010282121 | 12/2010 |
| JP | 2014-044275 | 3/2014 |

OTHER PUBLICATIONS

Office Action mailed Sep. 30, 2014, filed in corresponding Japanese Patent Application No. 2013-017423, with English translation.

* cited by examiner

*Primary Examiner* — Kristal Feggins
(74) *Attorney, Agent, or Firm* — Patterson & Sheridan LLP

(57) ABSTRACT

An erasing apparatus according to an embodiment includes an erasing section configured to erase an image formed on a sheet by heating the sheet that is transported through the erasing section, the erasing section including a heating roller, a press roller in contact with the heating roller. A motor rotates the heating and press rollers. A transportation section transports the sheet. The erasing apparatus further includes a controller that controls the erasing section and the transportation section so that a transportation speed of the sheet transported through the erasing section is a first transportation speed lower than a normal speed if a predetermined period of time from a start of a job has not elapsed.

20 Claims, 7 Drawing Sheets

ERASING APPARATUS

CROSS-REFERENCE TO RELATED APPLICATION

This application is based upon and claims the benefit of priority from Japanese Patent Application No. 2013-017423, filed Jan. 31, 2013, the entire contents of which are incorporated herein by reference.

FIELD

Embodiments described herein relate generally to a decoloring apparatus (erasing apparatus) which erases an image by performing decoloring with respect to a sheet on which the image has been formed with a decolorable coloring material.

BACKGROUND

In the related art, there is a decoloring apparatus which erases an image by heating a sheet, on which the image has been formed with a decolorable coloring material, to a decoloring temperature.

The decoloring is performed in such a decoloring apparatus. However, there is a case where the temperature in the environment in which the apparatus operates is low or a case where residual image from the decoloring may be present because the temperature of a decoloring section is insufficient if a decoloring job is immediately started from a state where the decoloring section is stopped, such as after a jam is released or the like. In order to avoid this situation, in the related art, there is a proposal in which a process is not started until the temperature of the decoloring section reaches a decoloring temperature from heating the decoloring section, and the process is started after the temperature of the decoloring section reaches the decoloring temperature.

However, in this case, since it takes time for a sheet which is set in a feeding tray to be fed into the inside of a body thereof even though a user presses a process start button, there is a problem that the user does not know whether the process has started.

DETAILED DESCRIPTION

An embodiment is provided to solve the problems described above and an object thereof is intended to provide a technique in which it is possible to immediately supply the sheet to the inside of the body of the decoloring apparatus when the job is started while suppressing the occurrence of residual images.

An erasing apparatus according to an embodiment includes an erasing section configured to erase an image formed on a sheet by heating the sheet that is transported through the erasing section, the erasing section including a heating roller, a press roller in contact with the heating roller. A motor rotates the heating and press rollers. A transportation section transports the sheet. The erasing apparatus further includes a controller that controls the erasing section and the transportation section so that a transportation speed of the sheet transported through the erasing section is a first transportation speed lower than a normal speed if a predetermined period of time from a start of a job has not elapsed.

A decoloring apparatus according to an embodiment saves time until a temperature of a decoloring section reaches a decoloring temperature by driving a transportation section at a low transportation speed in a predetermined period of time from starting the decoloring, and performs the decoloring by heating over a long time by driving the decoloring section at a low decoloring speed. Therefore, occurrence of decoloring residues can be prevented. If the temperature of the decoloring section increases and normal decoloring is enabled, the transportation speed and the decoloring speed are returned to normal speed.

Hereinafter, each embodiment will be described with reference to the drawings. Furthermore, in the following description, a sheet is described as a paper medium; however, the embodiment is not limited thereto and the sheet may be a material made of plastic, cloth or the like.

First Embodiment

Figure 1:
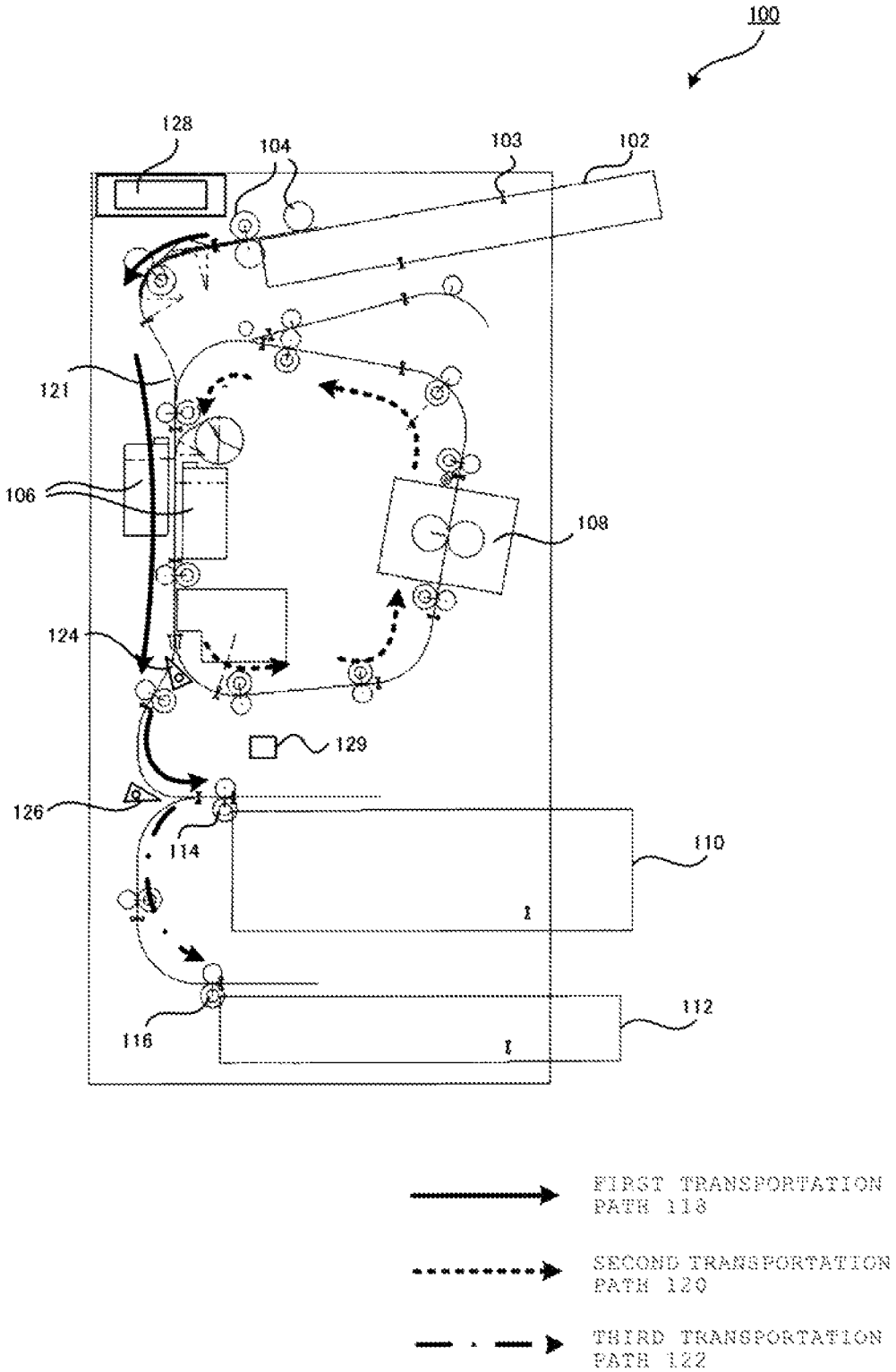
FIG. 1 is a view illustrating a an example configuration of a decoloring apparatus, according to an embodiment.

FIG. 1 is a schematic view describing a configuration of a decoloring apparatus. A decoloring apparatus 100 (erasing apparatus) performs decoloring (erasing) which decolors an image formed with a decolorable coloring material (erasable coloring material) with respect to a sheet on which the image is formed. The decolorable coloring material is an image forming material such as decolorable toner or decolorable ink. The decolorable coloring material includes a color generating compound, a color developer and a decoloring agent. For example, the color generating compound may include leuco dyes. For example, the color developer may include phenols. For example, the decoloring agent may include a material which is compatible with the color generating compound when being heated and has no affinity with the color developer. The decolorable coloring material is decolored because the decolorable coloring material is colored by interoperation between the color generating compound and the color developer. The interoperation between the color generating compound and the color developer is cut off by heating at a decoloring temperature or higher. Hereinafter, the decolorable coloring material is referred to as a recording material if necessary.

The decoloring apparatus 100 includes a feeding tray 102, a feeding member 104, a reading section 106, a decoloring section 108, a first tray 110, a second tray 112, discharging members 114 and 116, a first transportation path 118, a second transportation path 120, a third transportation path 122, a first branch member 124, a second branch member 126, and a display operation section 128. Furthermore, in FIG. 1, the first transportation path 118 is indicated by a solid arrow, the second transportation path 120 is indicated by a dashed arrow and the third transportation path 122 is indicated by a dashed-dotted arrow.

The feeding tray 102 loads the sheets for reuse. The feeding tray 102 loads sheets of various sizes such as A5, A4, A3 and B5. For example, the sheet which is loaded on the feeding tray 102 is a sheet on which the image is formed by the recording material decolored by heating at a predetermined fixing temperature or higher. The feeding member 104 has a pickup roller, a sheet supply roller, a separating roller disposed opposite to the sheet supply roller, or the like. The feeding member 104 supplies the sheets loaded on the feeding tray 102 to the first transportation path 118 inside the decoloring apparatus 100 one by one. Furthermore, the feeding tray 102 has a detection sensor 103 detecting the presence or absence of the sheets on the feeding tray 102 and detecting the sheet size.

The first transportation path 118 transports the sheet supplied from the feeding tray 102 to the reading section 106 and transports the sheet to a discharging section of the first tray 110.

The reading section 106 is positioned downstream of the feeding tray 102 in a sheet transportation direction and is disposed along the first transportation path 118. For example, the reading section 106 has a reading unit such as a Charge Coupled Device (CCD) scanner or a CMOS sensor. In the embodiment, the reading section 106 reads the image on a first surface and the image on a second surface of the sheet which is transported. That is, the reading section 106 includes two reading units disposed along the first transportation path 118 and across the transportation path, and can read the image of both surfaces of the sheet which is transported. The image read by the reading section 106 is stored in a memory 210 or a storage section 205 described below. For example, image data of the image on the sheet which is read by the reading section 106 before decoloring is sent to the storage section 205 and stored. In this way, the data of the decolored image can be retrieved later, if necessary. In addition, a controller 200 described below determines whether or not the sheet is a decolorable sheet or whether or not the sheet is a reusable sheet, based on the image which is read by the reading section 106.

The first branch member 124 functions as a switching section and is positioned downstream of the reading section 106. The first branch member 124 switches the transportation direction of the sheet which is transported. The first branch member 124 transports the sheet transported in the first transportation path 118 to the second transportation path 120 or to the first tray 110. The second transportation path 120 is a transportation path which branches from the first transportation path 118 in the first branch member 124 located between the reading section 106 and the first tray 110, and transports the sheet to the decoloring section 108. Furthermore, the second transportation path 120 joins the first transportation path 118 at a joint point 121 located upstream of the reading section 106 in the sheet transportation direction. Therefore, the second transportation path 120 can transport the sheet transported from the reading section 106 to the reading section 106 again through the decoloring section 108. In other words, the decoloring apparatus 100 can transport the sheet supplied from the feeding member 104 to the reading section 106, the decoloring section 108 and the reading section 106 in this order by controlling the first branch member 124.

The first transportation path 118 has a second branch member 126 downstream of the first branch member 124. The second branch member 126 guides the sheet transported from the first branch member 124 to the first tray 110 or the third transportation path 122. The third transportation path 122 transports the sheet to the second tray 112.

The decoloring section 108 erases the image formed on the sheet which is transported. For example, the decoloring section 108 decolors the color of the image formed on the sheet with the recording material by heating the sheet to a predetermined decoloring temperature in a state of being in contact with the sheet which is transported.

Figure 2:
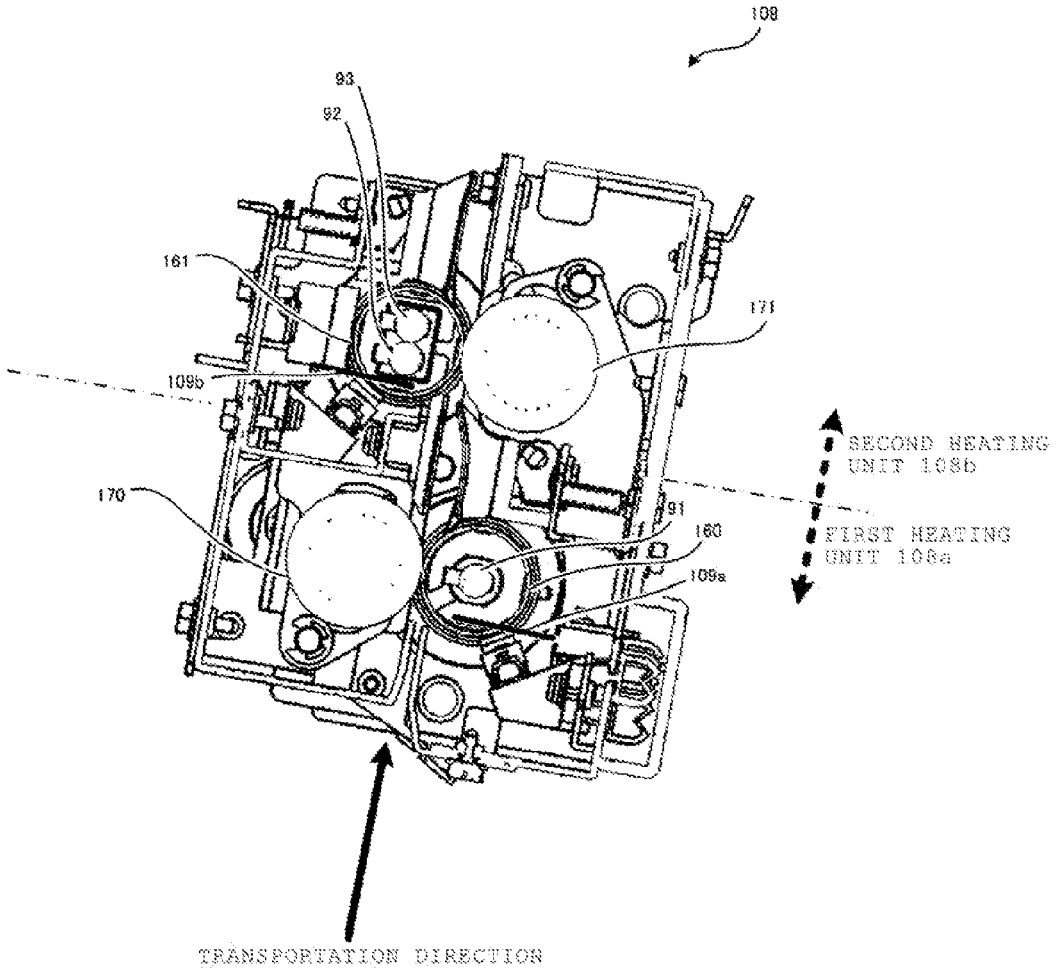
FIG. 2 is a view illustrating a configuration of a decoloring section according to the embodiment.

FIG. 2 illustrates a configuration of the decoloring section 108. The decoloring section 108 has two of a first heating unit 108*a* and a second heating unit 108*b* for decoloring of the first surface and the second surface of the sheet. The first heating unit 108*a* and the second heating unit 108*b* have heating rollers 160 and 161 which generate heat by being supplied an electric power, respectively, and are disposed side by side in the sheet transportation direction of the second transportation path 120. The heating roller 160 of the first heating unit 108*a* has a main heater 91 and heats the sheet by coming in contact with the sheet from one side surface of the sheet. The sheet, as it is transported, is pressed to the heating roller 160 by a press force of a press roller 170 and the heat is transmitted to the sheet. The press roller 170 is positioned opposite to the heating roller 160 and comes in contact with the heating roller 160 when the sheet is not present, and makes the heating roller 160 come in contact with the sheet surface when the sheet is present.

Furthermore, the heating roller 161 of the second heating unit 108*b* has a main heater 92 and a sub-heater 93, and heats the sheet by coming in contact with the sheet from the other side surface of the sheet. The sheet, as it is transported, is pressed to the heating roller 161 by a press force of a press roller 171 and the heat is transmitted to the sheet. The press roller 171 is positioned opposite to the heating roller 161 and comes in contact with the heating roller 161 when the sheet is not present, and makes the heating roller 161 come in contact with the sheet surface when the sheet is present. That is, the decoloring section 108 decolors the image of both surfaces of the sheet which is transported by transportation of the sheet once. Furthermore, the decoloring section 108 has temperature detectors 109*a* and 109*b* detecting temperatures of the heating rollers 160 and 161, respectively. The temperature detectors 109*a* and 109*b* have thermistors positioned in the outer periphery of the rollers of the heating rollers 160 and 161. The temperature detectors 109*a* and 109*b* may be a non-contact type or a contact type.

Further, in the example, the first heating unit 108*a* includes one main heater 91. On the other hand, the second heating unit 108*b* located on the downstream side of the transportation path includes a main heater 92 and a sub-heater 93 having a thermal capacitance smaller than that of the main heater 91 of the first heating unit 108*a*. However, the embodiment is not limited thereto. Each heating unit 108*a* and 108*b* may be configured with one heating source heater, or they may be configured of two or more heating source heaters.

The description returns to FIG. 1. The display operation section 128 disposed on an upper portion of the body of the decoloring apparatus 100 has a panel type display section, a touch panel laminated on the display section and an operation section including various operation keys. For example, the operation keys have numeric keys or the like. A user instructs functional operation of the decoloring apparatus 100 such as starting of decoloring or reading of the image of the sheet to be decolored through the display operation section 128. The display operation section 128 displays setting information, operation status and log information of the decoloring apparatus 100, or messages to the user.

The discharging members 114 and 116 discharge the sheet to the first tray 110 and the second tray 112 disposed vertically in the lower portion of the body. The first tray 110 receives sheets on which the image is decolored and which becomes reusable. The second tray 112 receives sheets which are determined to be non-reusable. Hereinafter, the first tray 110 is referred to as a reuse tray and the second tray 112 is referred to as a reject tray. In addition, the reuse tray 110 and the reject tray 112 can also replace the sheet that is an object to be received. Setting of each tray on which what sheet is loaded, that is, setting of the destination of the sheet may be performed from the display operation section 128. The second branch member 126 switches the transportation path according to the setting and guides the sheet which is transported to the first tray 110 or the third transportation path 122.

The decoloring apparatus 100 has an environmental temperature detector 129 for detecting an environmental temperature inside the decoloring apparatus 100, in addition to the temperature detectors 109*a* and 109*b* inside the decoloring section 108. For example, the environmental temperature detector 129 is disposed at a location where the heat influence from a heating body such as the decoloring section 108 is negligible. The environmental temperature detector 129 may also measure a temperature of the outside of the decoloring apparatus 100.

Figure 3:
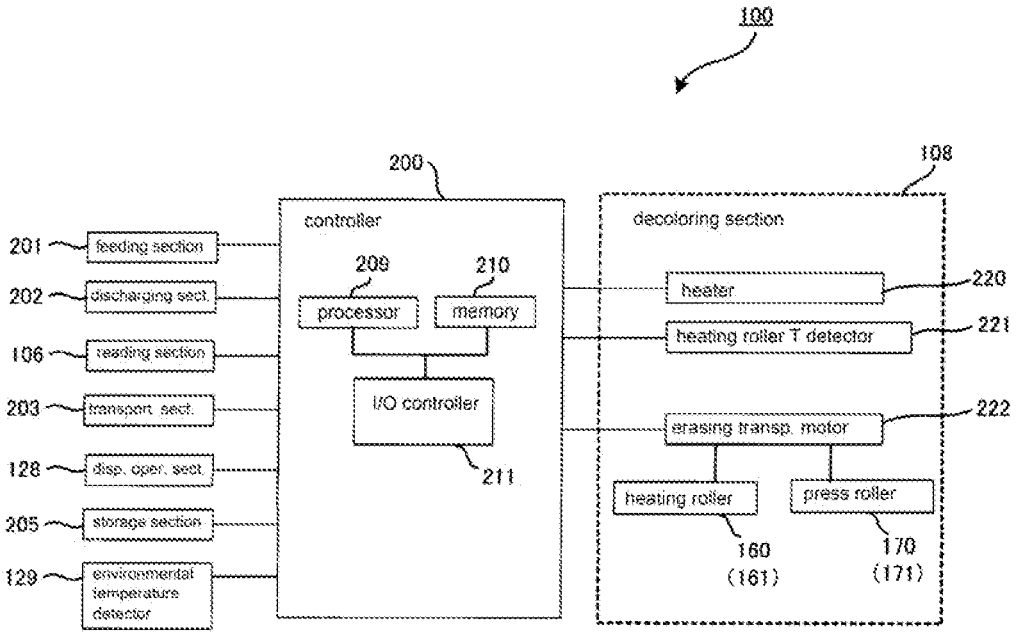
FIG. 3 is a block diagram of the decoloring apparatus, according to the embodiment.

FIG. 3 is a block diagram of the decoloring apparatus 100. The decoloring apparatus 100 has the controller 200, a feeding section 201, a discharging section 202, the reading section 106, a transportation section 203, the display operation section 128, the storage section 205, the environmental temperature detector 129, and the decoloring section 108. The feeding section 201 loads the sheet to be processed and feeds the sheet to the body section of the decoloring apparatus 100, and includes the feeding tray 102, the detection sensor 103 and the feeding member 104. The discharging section 202 stores the sheet after being processed in the body section of the decoloring apparatus 100, and includes the discharging members 114 and 116, the reuse tray 110 and the reject tray 112. The transportation section 203 transports the sheet to each unit, and includes the first transportation path 118, the second transportation path 120 and the third transportation path 122. The transportation section 203 also includes a motor (not illustrated) which controls the rotation of roller pairs in each transportation path. The storage section 205 is a Hard Disk Drive (HDD) for storing user data, setting data used in a system or the like in nonvolatile manner. The storage section 205 may permanently store image data read by the reading section 106.

The controller 200 provides overall control of each type of hardware inside the decoloring apparatus 100. The controller 200 includes a processor 209, the memory 210 and an I/O controller 211 (I/O: Input/Output). For example, the processor 209 is a Central Processing Unit (CPU) or a Micro Processing Unit (MPU) and performs instructions or the like for each type of hardware by executing calculation of program stored in the memory 210 or the storage section 205 beforehand. For example, the memory 210 is a semiconductor memory and has a Read Only Memory (ROM) for storing various control programs and a Random Access Memory (RAM) for offering a temporal working area in the processor 209. For example, the memory 210 stores a printing rate of the sheet which is a threshold for determining whether or not the sheet is reusable, a threshold of a density for determining whether or not the image is decolored, or the like. The memory 210 may temporarily store the image which is read by the reading section 106. Each unit of the decoloring apparatus 100 is connected to each other through the I/O controller 211, which performs transmitting and receiving of instruction signals, data signals, and the like.

A heater 220 inside the decoloring section 108 illustrated in FIG. 3 corresponds to the main heaters 91 and 92, and the sub-heater 93. Furthermore, a heating roller temperature detector 221 corresponds to the temperature detectors 109*a* and 109*b*. An erasing transportation motor 222 is a motor which directly controls a rotation driving or rotation speed of the heating rollers 160 and 161 and the press rollers 170 and 171, according to the instruction from the controller 200.

For example, the decoloring apparatus 100 can perform reading, decoloring, separating and pre-separating. The controller 200 of the decoloring apparatus 100 controls the reading section 106, the decoloring section 108 and other configurations depending on the processing which is set.

To perform reading, the controller 200 permanently stores the image which is read by the reading section 106 in the memory 210. In the decoloring, the controller 200 erases the image of the sheet by the decoloring section 108.

To perform separating, the controller 200 determines whether or not the sheet is reusable, based on the image which is read by the reading section 106. For separating, the controller 200 determines whether or not an image is on the sheet, based on the data read by the reading section 106 and determines that the sheet is a non-reusable sheet when an image is present. For example, the controller 200 determines that the sheet is a non-reusable sheet if there is an image that has not been fully erased, when the sheet is read after being decolored by the decoloring section 108. Furthermore, for separating, the controller 200 determines a wrinkle depth and the presence or absence of folding, and wearing, based on the data read by the reading section 106. If the wrinkle depth is a specified value or more, or if folding, wearing or holes are present, the decoloring apparatus 100 determines that the sheet is a non-reusable sheet. Further, separating only may be performed without decoloring. In this case, the sheet is discharged to the reuse tray 110 or the reject tray 112 according to the determination of being reusable or not in the controller 200.

In pre-separating, the controller 200 determines the printing rate of the image on the sheet, based on the data read by the reading section 106 before decoloring is performed. If the printing rate is a predetermined value or more, the controller 200 determines that the sheet is a non-reusable sheet without performing decoloring. The controller 200 discharges the sheet which is determined to be a non-reusable sheet to the reject tray 112. Otherwise, the controller 200 may determine whether or not prohibition data (such as secret data) for which decoloring is prohibited is included in the data of the image on the sheet read by the reading section 106. If the data for which decoloring is prohibited is included, the controller 200 transports the sheet to the reject tray 112.

Figure 4:
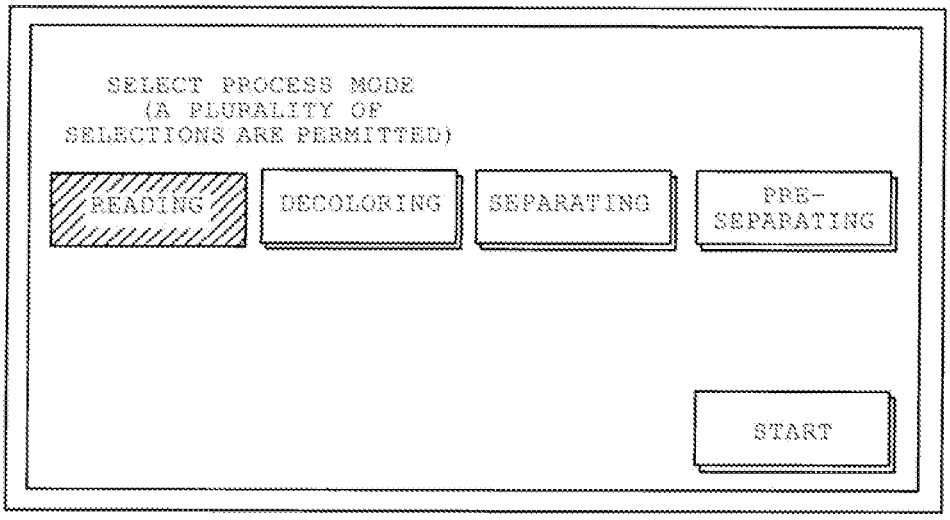
FIG. 4 is an example of a display for selecting a mode of the decoloring apparatus, according to the embodiment.

Selection of the desired processes can be set in the display operation section 128 of the decoloring apparatus 100. FIG. 4 illustrates an example of a menu screen in the display operation section 128. The user presses each button on the menu screen that corresponds to the desired processes is selected. For example, as illustrated in FIG. 4, if only the "reading" button is pressed, the controller 200 performs only reading with respect to the sheet and does not perform decoloring or separating. In addition, for example, if the "reading" button and the "decoloring" button are pressed, the controller 200 controls each unit so that the reading and decoloring processes are performed. As described above, reading, decoloring, separating and/or pre-separating can be selected in an appropriate combination through the display operation section 128.

Furthermore, in the decoloring apparatus 100 of the embodiment, if the processes described above are combined, as an example, the processes are performed in the following order: reading, decoloring, and then separating. In addition, priorities of the reading and the pre-separating are equal to each other. For example, if reading, decoloring and separating are selected, the decoloring apparatus 100 performs the processes in the following order: reading by the reading section 106, decoloring by the decoloring section 108, and separating by the reading section 106. That is, the image of the sheet is read by the reading section 106 before the decoloring section 108 decolors the image of the sheet, and the reading section 106 reads the image of the sheet which is decolored after the decoloring section 108 decolors the image of the sheet, for the separating process. If pre-separating, decoloring and separating are selected, the decoloring apparatus 100 performs the processes in the following order: pre-separating by the reading section 106, decoloring by the decoloring section 108, and separating by the reading section 106. If reading and pre-separating are both selected, the decoloring apparatus 100 performs reading, based on the data which is read by the reading section 106, and the pre-separating, based on the printing rate, at the same time.

A pressed state of each button—i.e., the "reading" button, the "decoloring" button, the "separating" button, and the "pre-separating" button is stored as flag data in the storage section 205 or the memory 210 when the user operates the button. The controller 200 acquires the flag data from the storage section 205 or the memory 210 when the "start" button is pressed, and determines whether to perform each process, based on the flag data.

In the decoloring apparatus of the related art, there is no problem in normal operation. However, when increasing the temperature of the decoloring section from a state where the temperature is relatively low (for example, immediately after the power is turned on, immediately after a jam is removed, or the like), even though the temperature of the heating roller increases to the decoloring temperature, the temperature of the press roller does not increase at the same rate as the heating roller. When the decoloring is performed on the sheet in this state, there is a concern that the decoloring residues may occur.

In the embodiment, the transportation speed is reduced during a predetermined period of time from the start of the job. In addition, occurrence of residual image from the decolorable coloring material can be prevented by decreasing the transportation speed inside the decoloring section 108 and by increasing a thermal capacitance applied to the sheet. Further, the deceleration control may finish the decelerating depending on the number of sheets which are passed through.

In addition, if a sheet of a small size is decolored, especially, a sheet which is short in a width length in a direction orthogonal to the transportation direction is decolored, the sheet comes in contact with only a part (for example, only a central portion) of the heating rollers 160 and 161 in addition to the problem described above. Since the heat of the heating rollers 160 and 161 is removed by the sheet at the portion which comes in contact with the sheet, the temperature thereof decreases. In the case of the sheet which has a short width, however, the heat thereof is not removed at other portions (for example, both-end portions) which do not come in contact with the sheet, and the temperature thereof does not decrease. The heaters 91 to 93 maintain the temperature of the whole surfaces of the heating rollers 160 and 161, but the temperature of the portions which do not come in contact with the sheet continuously increases and a problem may occur. Therefore, in the embodiment, when the sheet size is confirmed and the sheet is the small size, the transportation speed is decreased. Accordingly, it is possible to prevent a temperature difference of the heating rollers 160 and 161 between the portion which comes in contact with the sheet and the portion which does not come in contact with the sheet from becoming great.

Conditions for performing deceleration control, or not, are described as follows.

1. If the job is started after a predetermined period of time elapses (for example, 1 minute) from the start of heating of the heaters 91 to 93, the deceleration control is not performed.

2. If the temperature of the heating rollers 160 and 161 is a predetermined temperature (for example, 100° C. or more) when the job is stared, the deceleration control is not performed.

3. If the environmental temperature of the apparatus is a predetermined temperature or less (for example, 20° C. or less), the deceleration control is performed even when the temperature of the heating roller is a predetermined temperature (for example, 100° C.), because it is not easy to increase the temperature to the decoloring temperature.

4. If the environmental temperature of the apparatus is a predetermined temperature or less (for example, 20° C. or less), the deceleration control is performed even when the predetermined period of time (in number 1, above) elapses.

5. If the sheet is the small size, the deceleration control is performed.

Figure 5:
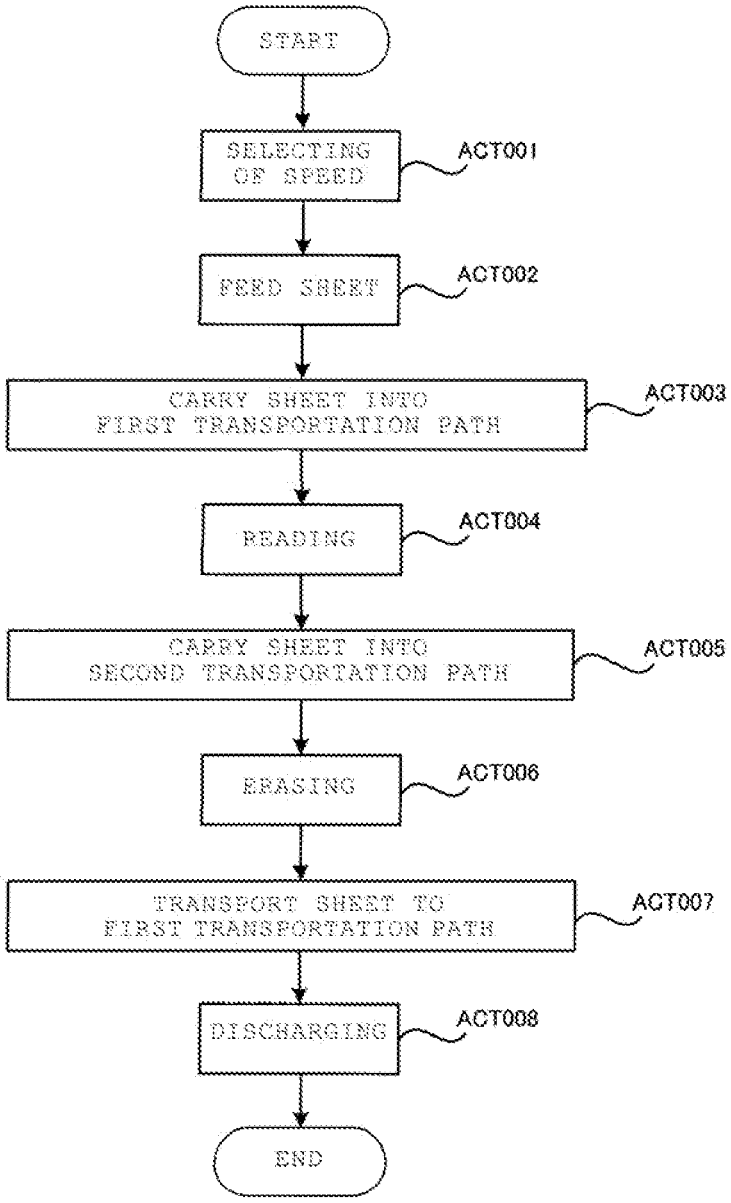
FIG. 5 is a flowchart illustrating a sequence of operations of the decoloring apparatus, according to the embodiment.
Figure 6:
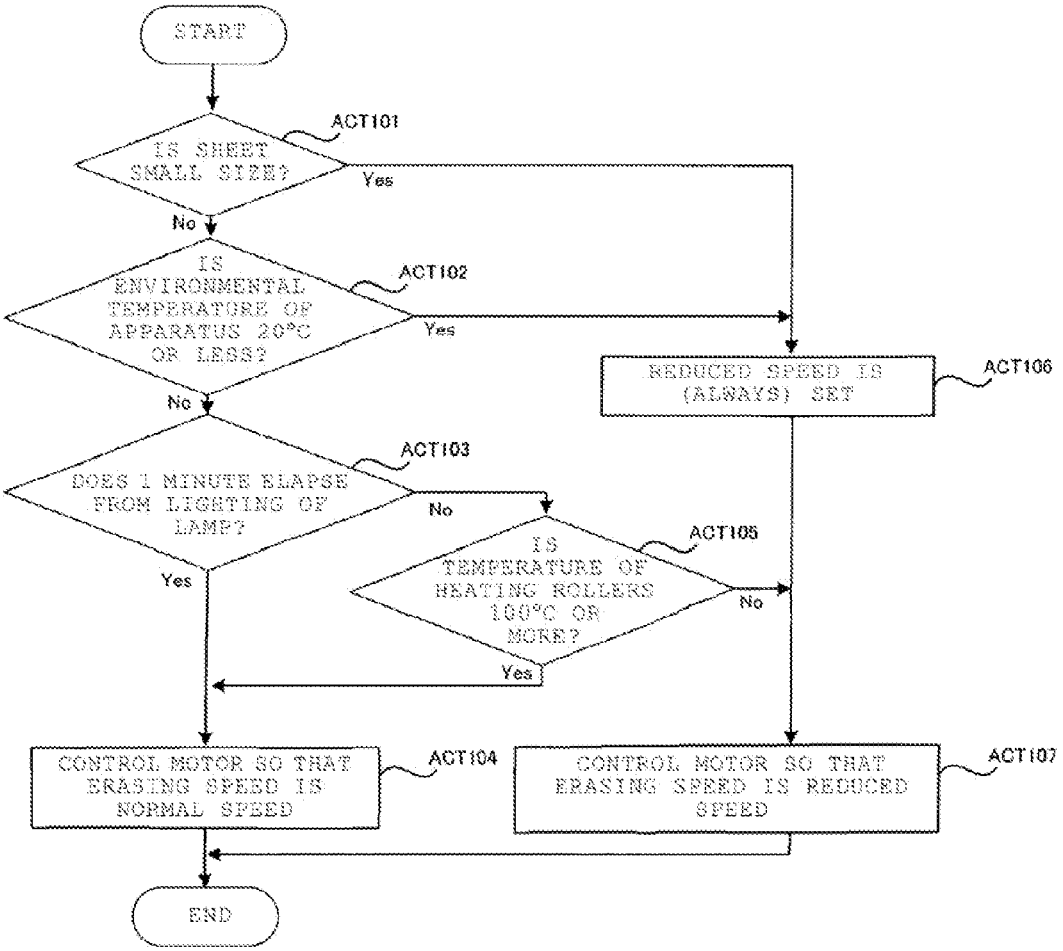
FIG. 6 is a flowchart illustrating a sequence of operations for selecting a speed.
Figure 7:
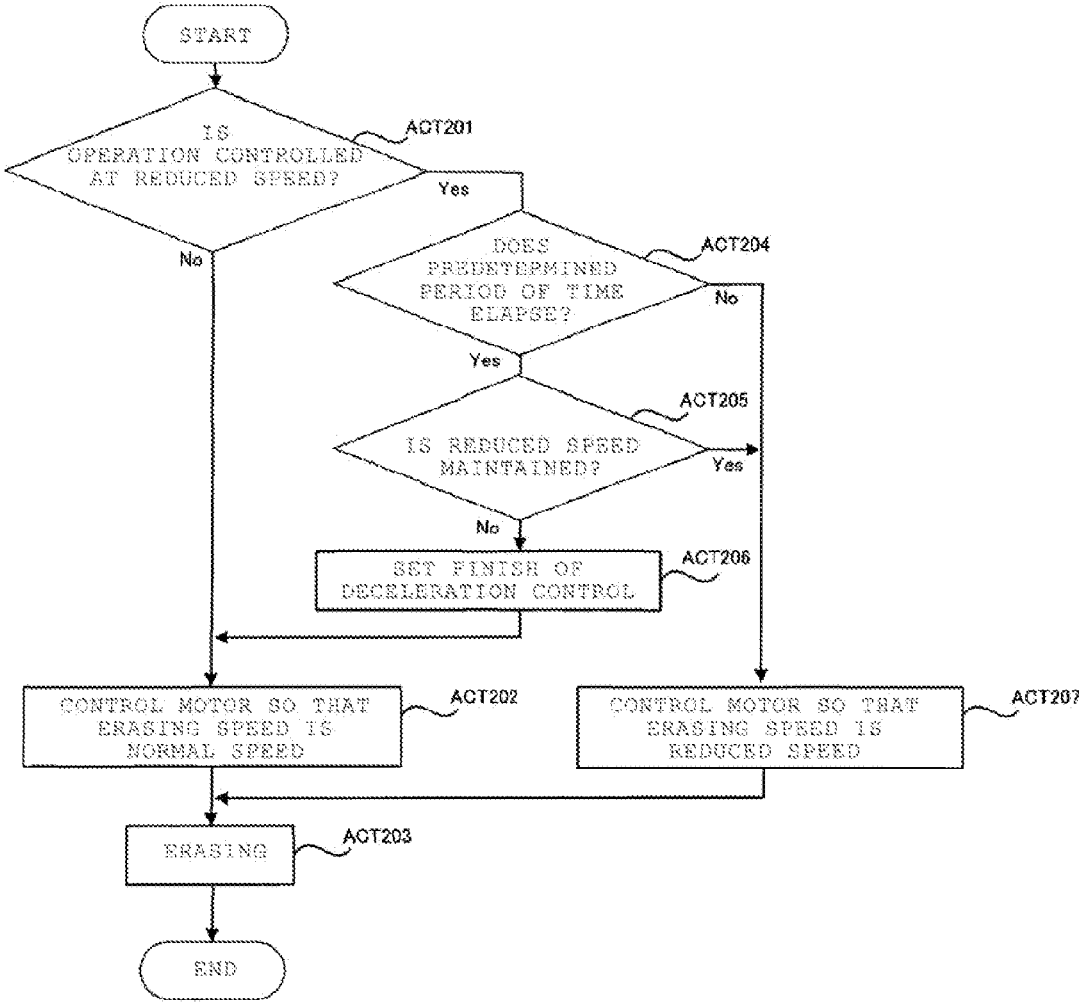
FIG. 7 is a flowchart illustrating a sequence of operations for erasing, according to the first embodiment.

The control operation will be described with reference to FIGS. 5 to 7. The following control operation is described in a mode in which the "reading" button and the "decoloring" button are pressed.

First, the operations are described with reference to FIG. 5. The controller 200 performs selecting of the transportation speed (ACT001). Details of the process will be described later. After selecting the transportation speed, the feeding section 201 supplies the loaded sheets to the body section of the decoloring apparatus 100 one by one (ACT002). The supplied sheet is carried into the first transportation path 118 (ACT003) and the reading section 106 performs the reading with respect to both surfaces of the sheet (ACT004). The controller 200 stores the image which is read in the storage section 205.

The sheet after the reading is transported to the second transportation path 120 by control of the first branch member 124 (ACT005). The decoloring section 108 performs the decoloring (erasing) of the image with respect to both surfaces of the sheet (ACT006). Detailed operation of the decoloring will be described later. After decoloring, the sheet is transported to the first transportation path 118 again at the joint point 121 (ACT007) and is discharged to the reuse tray 110 in the example (ACT008).

Further, when only the "decoloring" button is pressed, the reading in ACT004 is omitted. Furthermore, when the "separating" button or the "pre-separating" button is pressed, the operation is performed with each process described above.

Next, detailed operation of selecting the transportation speed (ACT 001, above) is described with reference to FIG. 6. The description is given in which the selecting of the transportation speed is performed at a timing when the "start" button is pressed. That is, selecting the transportation speed is performed only once per one job when starting the job. However, selecting the transportation speed may be performed for each sheet. In the following description, the magnitude relation of (normal speed)>(reduced speed) is established for each speed and a large value means high speed.

The controller 200 determines the size of the sheet to be processed by acquiring information about the size from a sensor on the transportation path (ACT101). Further, the size of the sheet may be detected by the detection sensor 103 of the feeding tray 102. In the example, the controller 200 determines whether or not the sheet is shorter than the width size of an A4 size on the basis of the A4 size as a predetermined size. However, a different size may be used as the predetermined size for comparison. When the sheet is shorter than the predetermined size (ACT101, Yes), the reduced speed is always set to be maintained within the job concerned (ACT106). Here, a predetermined flag data (referred to as first flag data) in the storage section 205 or the memory 210 is set to be a value indicating the maintenance of the reduced speed.

The controller 200 controls the erasing transportation motor 222 or a motor driving the transportation roller inside the second transportation path 120 so that the operation of erasing is performed at the reduced speed (ACT107). Therefore, the transportation of the second transportation path 120 or the rotation of the heating rollers 160 and 161, and the press rollers 170 and 171 is performed at the reduced speed. At ACT107, the controller 200 sets a level of the speed which rotates the roller pair in a specified storage area. Here, a value of the level indicating the reduced speed is set. Each transportation motor controls the driving of the roller pair so as to be the speed according to the set value.

The process returns to the determination of ACT101. If the sheet is not the small size (ACT101, No), the controller 200 acquires the current environmental temperature in the apparatus from the environmental temperature detector 129 and determines whether or not the temperature is 20° C. or less (ACT102). If the temperature is 20° C. or less (ACT102, Yes), the controller 200 sets and maintains the reduced speed (ACT106) and controls each motor so as to be the reduced speed (ACT107). If the environmental temperature in the apparatus is not 20° C. or less (ACT102, No), the controller 200 determines whether or not 1 minute has elapsed from the start of heating of the main heaters 91 and 92, and the subheater 93 (ACT103). The time or the like from the start of heating of the heaters 91 to 93 is managed based on the clock in the controller 200 and the controller 200 performs the determination of ACT103 by acquiring the time information.

When 1 minute does not elapse from the start of heating of the heaters 91 to 93 (ACT103, No), the controller 200 acquires the information of the temperature from the heating roller temperature detector 221 and determines whether or not the temperature of the heating rollers 160 and 161 is 100° C. or more (ACT105). If the temperature thereof is not 100° C. or more (ACT105, No), the controller 200 controls the motor so as to have the reduced speed (ACT107). If a jam occurs and then removing work of the sheet is performed by a hand of the user, the heaters 91 to 93 are completely turned off. However, if the jam is cleared in a short time, the heating rollers 160 and 161 may be in a high temperature state already at a stage when the heaters 91 to 93 are started again. ACT105 is an implementation taking into account the situation when 1 minute does not elapse from the start of heating of the heaters 91 to 93 (ACT103, No), in which case the process is performed at normal speed if the temperature of the heating rollers 160 and 161 is high (ACT105, Yes). In addition, the state in ACT103 is not limited to a state where the heaters 91 to 93 generate heat to the decoloring temperature and also includes a state of being kept warm at a temperature lower than the decoloring temperature (a standby state from which the decoloring temperature is accessible in a moment), and the embodiment is not limited thereto.

When 1 minute elapses from the start of heating of each of the heaters 91 to 93 (ACT103, Yes), or when the temperature of the heating rollers 160 and 161 is 100° C. or more (ACT105, Yes), the controller 200 controls the erasing transportation motor 222 or the motor which drives the roller pair in the second transportation path 120 so that the operation of the erasing is performed at the normal speed (ACT104). Therefore, the transportation of the second transportation path 120 or the rotation of the heating rollers 160 and 161, and the press rollers 170 and 171 is performed at the normal speed. Here, the controller 200 sets the value of the speed level indicating the normal speed and controls the driving of each of the transportation motors according to the set value.

Next, detailed operation when performing the decoloring of ACT006 will be described with reference to FIG. 7. The operation in FIG. 7 is described as being performed for each sheet.

The controller 200 determines whether the operation is controlled at the normal speed or is controlled at the reduced speed by referring to the value of the speed level which is currently set (ACT201). When the operation is not controlled at the reduced speed, that is, is controlled at the normal speed (ACT201, No), the controller 200 maintains the normal speed or controls the motor so as to be normal speed rather than the reduced speed (ACT202), and the decoloring is performed by the decoloring section 108 (ACT203). The decoloring is the operation of the related art in which the image is erased by heating the sheet.

Meanwhile, when deceleration control is performed (ACT201, Yes), the controller 200 determines whether or not a predetermined period of time (1 minute in the example) has elapsed from the start of paper feeding by the feeding section 201, that is, whether the "start" button is pressed and a predetermined period of time (1 minute in the example) has elapsed from the start of the job (ACT204). This determination is also provided to provide sufficient time until the heat generation of the heating rollers 160 and 161 is propagated to the roller surfaces of the press rollers 170 and 171, in addition to whether or not the roller surfaces of the heating rollers 160 and 161 reaches the decoloring temperature is determined. Therefore, the predetermined period of time may be regarded as a time until the temperature of the press rollers 170 and 171 increases to the predetermined temperature. In addition, the predetermined period of time is a value which is determined beforehand in the embodiment, but may be determined, based on characteristics of a surface material of the press rollers 170 and 171, the environmental temperature or the like.

When a predetermined period of time does not elapse (ACT204, No), the controller 200 controls each motor so as to be the reduced speed (ACT207) and the decoloring is performed by the decoloring section 108 (ACT203). When a predetermined period of time elapses from the start of the feeding (the start of the job) (ACT204, Yes), the controller 200 determines whether or not the value of the first flag data described above is the value indicating maintaining the reduced speed (ACT205). When the value of the flag is the value indicating the reduced speed is to be maintained (ACT205, Yes), the controller 200 controls each motor so as to be driven at a reduced speed (ACT207). Further, the driving at the reduced speed is always maintained by the determination of ACT205 when the environmental temperature is a predetermined temperature or less, or when the sheet of the small size is processed.

On the other hand, when the value of the first flag data is not the value indicating that the reduced speed is to be maintained (ACT205, No), the controller 200 sets the value of the speed level so as to finish the deceleration control, that is, controlled to have the normal speed (ACT206). Each of the transportation motors controls the roller pair so as to have the normal speed according to the value thereof (ACT202).

In the embodiment, a configuration example having the reading section 106 performing the image scanning is described; however, the configuration may not have the reading section 106. In this case, the configuration may include the decoloring section 108 in the first transportation path 118 and may not have the second transportation path 120. Furthermore, in this case, the transportation path to have deceleration control is the first transportation path 118.

Further, as described above, when processing the sheet of the small size, the controller 200 controls the speed so as to always be the reduced speed and also controls an amount of heat generation of the heating rollers 160 and 161 to be suppressed to be low. It is possible to ensure a proper amount of heat which is propagated to the sheet even though the amount of heat generation is suppressed to be low, by lowering a rotating speed of the heating rollers 160 and 161, and the press rollers 170 and 171, and by decelerating the processing speed in the decoloring section 108. Furthermore, it is possible to alleviate the temperature difference between the portion which comes in contact with the sheet and the portion which does not come in contact with the sheet by suppressing the amount of heat generation to be low.

The occurrence of a residual image from the decolorable coloring material is suppressed and it is not necessary to perform the pre-running, even when the "start" button is pressed, by the disclosed control of the embodiment. Therefore, when the "start" button is pressed, the sheet disposed in the feeding section 201 is immediately supplied to the inside of the body of the decoloring apparatus 100. Therefore, there is no situation in which the user cannot determine whether or not the job is started. In addition, it is possible to maintain the performance by executing this control under optimal situations.

Second Embodiment

Figure 8:
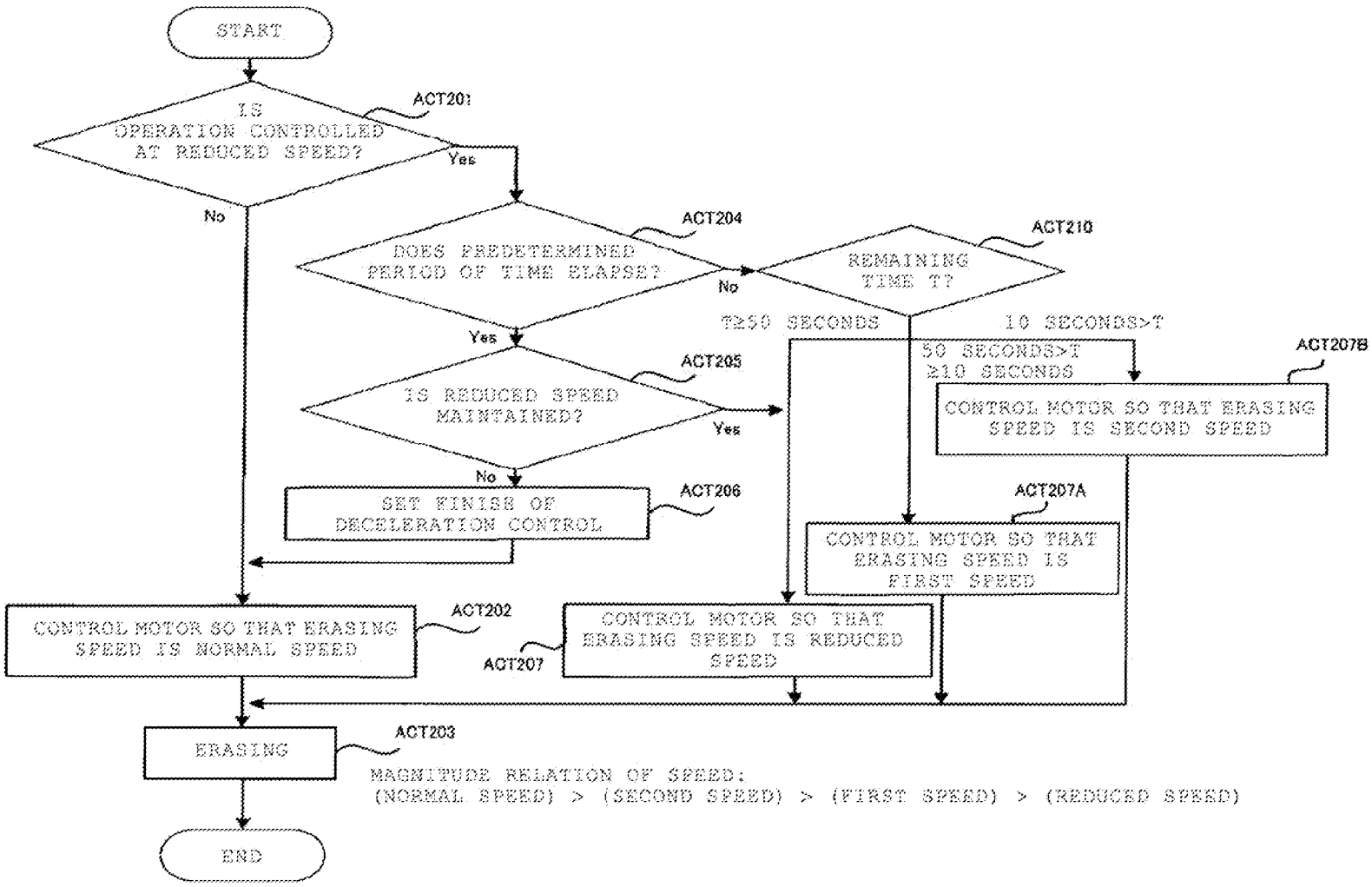
FIG. 8 is a flowchart illustrating a sequence of operations for erasing, according to a second embodiment.

In the second embodiment, am embodiment is described in which, when the reduced speed returns to the normal speed, the returning is performed by gradual acceleration. FIG. 8 illustrates a detailed operation example of the decoloring (ACT006) of FIG. 5 described above in the second embodiment. Further, the hardware configuration or the block diagram of the decoloring apparatus, the whole operation or the selecting operation of the speed, or the like is the same as the first embodiment (see FIGS. 1 to 6). A symbol referring to each unit is also derived from that of the first embodiment. Further, in FIG. 8, since the unit having the same symbol as that in FIG. 7 performs a similar operation as the first embodiment, the description thereof is omitted. Furthermore, in the following description, the magnitude relation of (the normal speed)>(the second speed)>(the first speed)>(the reduced speed) is established for each speed and a large value means a high speed.

At ACT204, when a predetermined period of time (1 minute in the example) does not elapse from the start of the job (ACT204, No), the controller 200 calculates a remaining time (T) by subtracting the current time point from a scheduled time point when a predetermined period of time elapses (ACT210).

When the remaining time T is 50 seconds or more (ACT210, T≥50 seconds), each transportation motor (the motor of the transportation section 203 and the erasing transportation motor 222) is controlled so that the speed of decoloring is the reduced speed (ACT207). When the remaining time T is less than 50 seconds and 10 seconds or more (ACT210, 50 seconds>T≥10 seconds), the controller 200 controls each transportation motor so that the speed of the decoloring is the first speed (ACT207A). Furthermore, when the remaining time T is less than 10 seconds (ACT210, 10 seconds>T), the controller 200 controls each transportation motor so that the speed of the decoloring is the second speed (ACT207B). Further, threshold seconds compared with the remaining time T are only an example. The control of the speed is performed by setting the value of the speed level in the specified area by the controller 200 similar to the first embodiment.

After operations of ACTS 207, 207A and 207B, the decoloring of ACT203 is performed. Furthermore, when a result of the determination of ACT205 is positive (ACT205, Yes), the reduced speed is assumed in the example; however, the first or the second speed are assumed depending on the design. Furthermore, the second embodiment is described with the speed being changed in four steps: the normal speed, the second speed, the first speed and the reduced speed; however, it is possible to perform the control of the speed more closely by increasing the number of cases of separate cases in ACT210.

Further, since the heat of the heating rollers 160 and 161 is deprived to the sheet by coming in contact with the sheet and by passing the sheet, if the speed or the temperature is switched in the sheet, it is necessary to perform complex adjustment in consideration of the lowered temperature. Therefore, it is preferable that switching of the speed described in the first and second embodiments be performed when the sheet is not present in the decoloring section 108. Furthermore, the first and second embodiments are described in which the speed is switched depending on the time (a predetermined period of time of ACT204 in FIGS. 7 and 8, or the remaining time T of ACT210 in FIG. 8); however, the speed may be switched depending on the number of sheets on which the decoloring is performed. Further, if the speed is switched based on the number of sheets which is processed, the number of sheets which is the threshold is determined also in consideration of the speed of the reading in the reading section 106 (the speed of the reading is slow in a case of high-resolution).

The numerical values or the like described in each embodiment described above are merely an example and embodiments are not limited thereto.

As described above, it is possible to immediately supply the sheet to the inside of the body of the decoloring apparatus when the job is started while suppressing the occurrence of the residual image from the decolorable coloring material by performing the control of the embodiment.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An erasing apparatus comprising:

an erasing section configured to erase an image formed on a sheet by heating the sheet that is transported through the erasing section, the erasing section including a heating roller, a press roller in contact with the heating roller, and a motor configured to rotate the heating and press rollers;

a transportation section that transports the sheet; and a controller that controls the erasing section and the transportation section so that a transportation speed of the sheet transported through the erasing section is a first transportation speed lower than a normal speed if a predetermined period of time from a start of a job has not elapsed.

2. The apparatus according to claim 1, wherein the controller controls the transportation speed at the first transportation speed if an environmental temperature in the erasing apparatus is a specified temperature or less.

3. The apparatus according to claim 1, wherein the controller controls the transportation speed to be the normal speed if the predetermined period of time from the start of the job has elapsed and if a temperature of the heating roller is equal to or more than a predetermined temperature.

4. The apparatus according to claim 1, wherein the controller controls the transportation speed to be an intermediate speed between the first transportation speed and the normal speed if the predetermined time has elapsed and a second predetermined time from the start of the job that is longer than the predetermined time has not elapsed.

5. The apparatus according to claim 1, wherein the controller controls the transportation speed at the first transportation speed if a width of the sheet is smaller than a predetermined size.

6. The apparatus according to claim 1, wherein the controller controls the transportation speed at the first transportation speed if the temperature of the heating roller is lower than a specified value when the job is started, and controls the transportation speed at the normal speed when the temperature of the heating roller is the specified value or more.

7. The apparatus according to claim 1, wherein the controller controls the transportation speed to be the first transportation speed if a second predetermined period of time does not elapse from a start of heating of a heater in the heating roller and controls the transportation speed to be the normal speed if the second predetermined period of time elapses from the start of heating of the heater.

8. A method of controlling an erasing apparatus that includes a transportation section that transports the sheet and an erasing section configured to erase an image formed on a sheet by heating the sheet that is transported through the erasing section, the erasing section including a heating roller, a press roller in contact with the heating roller, and a motor configured to rotate the heating and press rollers, the method comprising:

controlling a transportation speed of the sheet transported through the erasing section so that the transportation speed is a first transportation speed lower than a normal speed if a predetermined period of time from a start of a job has not elapsed.

9. The method according to claim 8, wherein the transportation speed is controlled so that the transportation speed is the first transportation speed if an environmental temperature in the erasing apparatus is a specified temperature or less.

10. The method according to claim 8, wherein the transportation speed is controlled so that the transportation speed is the normal speed if the predetermined period of time from the start of the job has elapsed and if a temperature of the heating roller is equal to or more than a predetermined temperature.

11. The method according to claim 8, wherein the transportation speed is controlled so that the transportation speed is an intermediate speed between the first transportation speed and the normal speed if the predetermined time has elapsed and a second predetermined time from the start of the job that is longer than the predetermined time has not elapsed.

12. The method according to claim 8, wherein the transportation speed is controlled so that the transportation speed is the first transportation speed if a width of the sheet is smaller than a predetermined size.

13. The method according to claim 8, wherein the transportation speed is controlled so that the transportation speed is the first transportation speed if the temperature of the heating roller is lower than a specified value when the job is started, and the transportation speed is the normal speed when the temperature of the heating roller is the specified value or more.

14. The method according to claim 8, wherein the transportation speed is controlled so that the transportation speed is the first transportation speed if a second predetermined period of time does not elapse from a start of heating of a heater in the heating roller, and the transportation speed is the normal speed if the second predetermined period of time elapses from the start of heating of the heater.

15. A non-transitory computer-readable medium storing instructions for controlling an erasing apparatus that includes a transportation section that transports the sheet and an erasing section configured to erase an image formed on a sheet by heating the sheet that is transported through the erasing section, the erasing section including a heating roller, a press roller in contact with the heating roller, and a motor configured to rotate the heating and press rollers, the instructions causing a computer to control the erasing apparatus by:

controlling a transportation speed of the sheet transported through the erasing section so that the transportation speed is a first transportation speed lower than a normal speed if a predetermined period of time from a start of a job has not elapsed.

16. The non-transitory computer-readable medium according to claim 15, wherein the instructions cause the computer to control the transportation speed so that the transportation speed is the first transportation speed if an environmental temperature in the erasing apparatus is a specified temperature or less.

17. The non-transitory computer-readable medium according to claim 15, wherein the instructions cause the computer to control the transportation speed so that the transportation speed is the normal speed if the predetermined period of time from the start of the job has elapsed and if a temperature of the heating roller is equal to or more than a predetermined temperature.

18. The non-transitory computer-readable medium according to claim 15, wherein the instructions cause the computer to control the transportation speed so that the transportation speed is an intermediate speed between the first transportation speed and the normal speed if the predetermined time has elapsed and a second predetermined time from the start of the job that is longer than the predetermined time has not elapsed.

19. The non-transitory computer-readable medium according to claim 15, wherein the instructions cause the computer to control the transportation speed so that the transportation speed is the first transportation speed if a width of the sheet is smaller than a predetermined size.

20. The non-transitory computer-readable medium according to claim 15, wherein the instructions cause the computer to control the transportation speed so that the transportation speed is the first transportation speed if the temperature of the heating roller is lower than a specified value when the job is started, and the transportation speed is the normal speed when the temperature of the heating roller is the specified value or more.

* * * * *